US010371414B2

(12) United States Patent
Hanks et al.

(10) Patent No.: US 10,371,414 B2
(45) Date of Patent: Aug. 6, 2019

(54) FURNACE BURNER HOLDERS, CARTRIDGES, ASSEMBLIES AND METHODS FOR THEIR INSTALLATION

(71) Applicant: TRANE INTERNATIONAL INC., Piscataway, NJ (US)

(72) Inventors: Andrew Hamilton Hanks, Tyler, TX (US); Delbert Steven Christopher, Reklaw, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 515 days.

(21) Appl. No.: 14/936,341

(22) Filed: Nov. 9, 2015

(65) Prior Publication Data

US 2016/0131398 A1 May 12, 2016

Related U.S. Application Data

(60) Provisional application No. 62/076,636, filed on Nov. 7, 2014.

(51) Int. Cl.

| | |
|---|---|
| ***F24H 9/06*** | (2006.01) |
| ***F23C 5/02*** | (2006.01) |
| ***F23D 14/08*** | (2006.01) |
| ***F23D 23/00*** | (2006.01) |

(52) U.S. Cl.

CPC ..... *F24H 9/06* (2013.01); *F23C 5/02* (2013.01); *F23D 14/08* (2013.01); *F23D 23/00* (2013.01)

(58) Field of Classification Search

CPC ..... F23D 23/00; F23C 5/02
USPC ..... 431/189, 286, 354; 126/21 A, 110 R
See application file for complete search history.

(56) References Cited

U.S. PATENT DOCUMENTS

| | | | | |
|---|---|---|---|---|
| 115,870 A | | 6/1871 | Lagorce | |
| 2,615,687 A | | 10/1952 | Simmons | |
| 2,892,234 A | | 6/1959 | Klein | |
| 3,198,238 A | * | 8/1965 | Hughes | F23D 14/46 239/417.5 |
| 4,415,019 A | | 11/1983 | Hunzicker | |
| 4,432,307 A | | 2/1984 | Godin | |
| 5,035,609 A | * | 7/1991 | Riehl | F23D 14/08 239/597 |
| 5,108,284 A | * | 4/1992 | Gruswitz | F23D 14/74 239/391 |
| 5,131,839 A | * | 7/1992 | Riehl | F23D 14/08 431/286 |

(Continued)

FOREIGN PATENT DOCUMENTS

| | | |
|---|---|---|
| CA | 2760309 | 6/2013 |

*Primary Examiner* — Steven B McAllister
*Assistant Examiner* — Desmond C Peyton
(74) *Attorney, Agent, or Firm* — Hamre, Schumann, Mueller & Larson, P.C.

(57) ABSTRACT

Burner holders and cartridges of a furnace are described herein, which include a support assembly and a manifold. The support assembly is configured to support one or more burners. For example, the support assembly may include a burner holder with a cutout region, which may allow a burner to be moved between an operational position and a disengaging position by twisting the burner. The cutout region can allow the one or more burners to be removed or installed relatively easily, without the need of removing the manifold from the support assembly. The manifold can be attached to the support assembly by, for example, using one or more orifices as fasteners.

12 Claims, 8 Drawing Sheets

(56) References Cited

U.S. PATENT DOCUMENTS 5,186,620 A * 2/1993 Hollingshead ..... F23D 14/045 239/558
5,188,526 A * 2/1993 Riehl ..... F23D 14/08 431/286
5,244,382 A * 9/1993 Riehl ..... F23D 14/08 431/286
5,286,190 A * 2/1994 Riehl ..... F23D 14/08 29/890.01
5,316,470 A * 5/1994 Sigler ..... F23D 14/08 239/552
5,318,439 A * 6/1994 Sigler ..... F23D 14/08 29/428
5,324,195 A * 6/1994 Sigler ..... F23D 14/02 239/597
5,361,749 A * 11/1994 Smith, Jr. ..... F24C 15/006 126/19 R
5,448,986 A * 9/1995 Christopher ..... F24H 3/105 126/110 R
5,460,157 A * 10/1995 Prabhu ..... F24C 15/006 126/21 A
8,021,143 B2 * 9/2011 Slaby ..... F23D 14/045 126/104 A
8,668,489 B2 * 3/2014 Chiappetta ..... F24H 3/105 126/110 C
9,062,879 B2 * 6/2015 O'Donnell ..... F23D 14/08
2002/0092516 A1 * 7/2002 Gierula ..... F24H 3/087 126/99 R
2003/0077551 A1 * 4/2003 Zia ..... F23D 14/08 431/354
2003/0084896 A1 * 5/2003 Gierula ..... F24H 3/087 126/110 R
2007/0272228 A1 * 11/2007 Slaby ..... F23D 14/045 126/104 A
2012/0178032 A1 * 7/2012 Roy ..... F23D 14/045 239/558
2015/0128926 A1 * 5/2015 Noman ..... F27D 99/0033 126/116 R
2015/0192291 A1 * 7/2015 Akbarimonfared ..... F23D 14/02 126/116 R

* cited by examiner

FURNACE BURNER HOLDERS, CARTRIDGES, ASSEMBLIES AND METHODS FOR THEIR INSTALLATION

FIELD

The disclosure herein relates to a burner system of a furnace, which may be, for example, included in a heating, venting and air conditioning (HVAC) system. More specifically, burner holders and cartridges are described that are configured to retain and support one or more burners. Support assemblies of the holders and cartridges may allow one or more burners to be removed and installed relatively easily from a burner system.

BACKGROUND

A furnace may be found in a HVAC system. The furnace typically includes a burner system, one or more heat exchangers, and a blower. The burner system can be configured to combust gas to generate heat, which can be used to, for example, heat air. Typically, the burner system may include one or more burners, a manifold, a gas valve and a support assembly to hold these components. These components are secured to the support assembly, for example by brackets and fasteners. The burners are a serviceable item and may need to be cleaned on a regular basis. However, the brackets and fasteners may make it difficult to remove and install the burners.

SUMMARY

Embodiments as disclosed herein are directed to burner holders and burner cartridges that may be used in a burner system, and which may include a support assembly configured to support at least one burner and a manifold.

In some embodiments, the manifold may be attached to the support assembly. With the burner holders and/or cartridges disclosed herein a burner may be removed or installed without dissembling the manifold from the support assembly.

In some embodiments, the support assembly may include a burner holder that includes a cutout region configured to accommodate a burner. The cutout region may include a first ear and a second ear to engage the burner. At least one of the first and second ears may have an angled portion, which is configured so that when the burner is twisted from an operational position to a disengaging position, the burner can have a clearance in the cutout region and be removed.

In some embodiments, the support assembly may include a locking member to close an opening of the cutout region to hold the burner in place. In some embodiments, the support assembly may be attached to the manifold of the burner by an orifice, which may function as a fastener.

In some embodiments, the burner holder may include a plurality of cutout regions, and profiles of the neighboring cutout regions are mirrored.

In some embodiments, the manifold is attached to the supporting assembly by an orifice.

Other features and aspects of the systems, methods, and control concepts will become apparent by consideration of the following detailed description and accompanying drawings.

BRIEF DESCRIPTION OF THE DRAWINGS

Reference is now made to the drawings in which like reference numbers represent corresponding parts throughout.

FIG. 2A is a perspective view of the burner system, and showing a locking member of a support assembly configured to hold multiple burners. FIG. 2B illustrates a close up view showing that the support assembly is attached to a manifold by an orifice. FIG. 2C illustrates a burner holder of the support assembly, according to one embodiment. FIGS. 2D and 2E are partial close up views of one of the burners and the burner holder of FIG. 2C. FIG. 2D illustrates one of the burners in an operational position. FIG. 2E illustrates one of the burners in a disengaging position.

FIG. 3A is a perspective view of the burner system, and showing a locking member of a support assembly configured to hold multiple burners. FIG. 3B illustrates a burner cartridge of the support assembly, according to one embodiment.

DETAILED DESCRIPTION

A furnace may include a burner system having one or more burners, a manifold, a gas valve, and a supporting structure to hold these components. Generally, the one or more burners may be fixed in place, for example, with brackets and fasteners. An end of the burners may also be fixed, for example, by attaching the end of the burners to the corresponding gas orifice. When brackets and fasteners are used as the primary ways of attaching the burners, a service technician may need to remove the manifold in order to remove the burners for service and/or maintenance. Removing the manifold may require a gas line to be broken and removed, which can increase a risk of the gas line not being sealed properly and/or take a relatively long period of time.

Burner holders and cartridges of a furnace are described herein, and which include a support assembly and a manifold. The support assembly is configured to support one or more burners. In one example, the support assembly may include a burner holder with a cutout region, which may allow a burner to be moved between an operational position and a disengaging position by twisting the burner. The cutout region can allow the one or more burners to be removed or installed relatively easily, without the need of removing the manifold from the support assembly. In another example, the support assembly is constructed as a cartridge.

With the holders and/or cartridges herein, the manifold can be attached to the support assembly by, for example, using one or more orifices as fasteners.

References are made to the accompanying drawings that form a part hereof, and in which is shown by way of illustration of the embodiments that may be practiced. It is to be understood that the terms used herein are for the purpose of describing the figures and embodiments and should not be regarded as limiting the scope.

Figure 1:
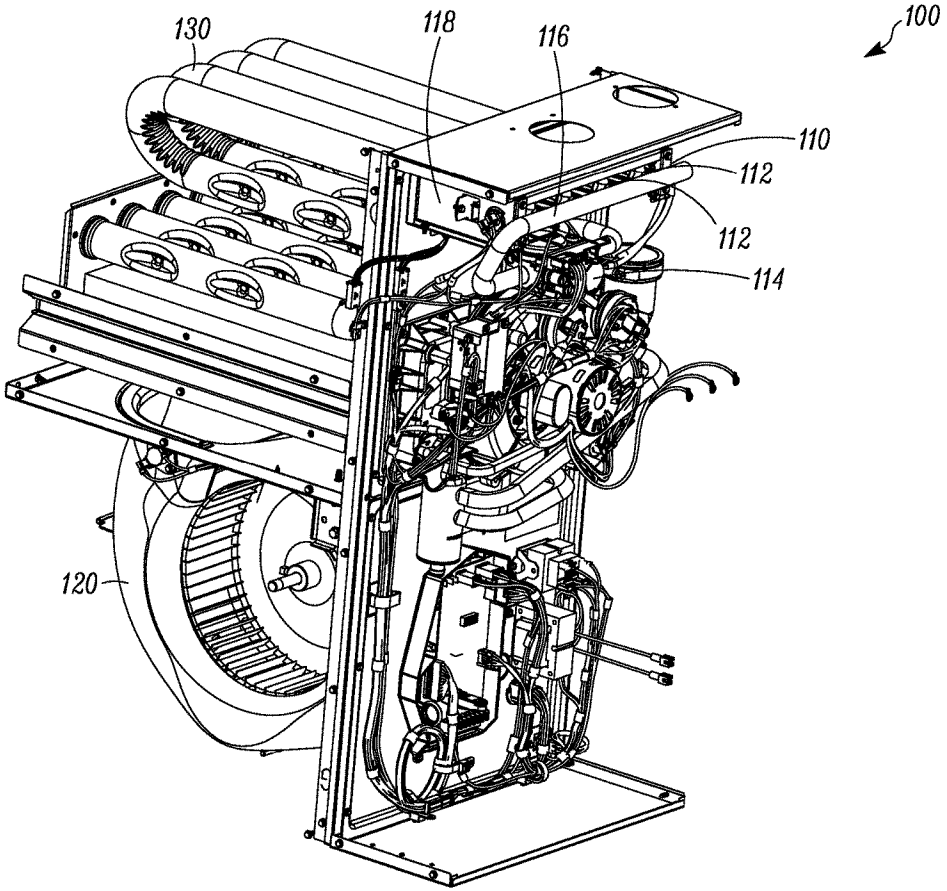
FIG. 1 illustrates a furnace, with which the embodiments as disclosed herein can be practiced.

FIG. 1 illustrates a furnace 100, with which the embodiments disclosed herein can be practiced. The furnace 100 can include a burner system 110, a blower 120, and at least one heat exchanger 130.

The burner system 110 includes one or more burners 112, a valve 114, a manifold 116 and a support assembly 118. The burner 110 is configured to combust gas to generate heat.

Figure 2A:
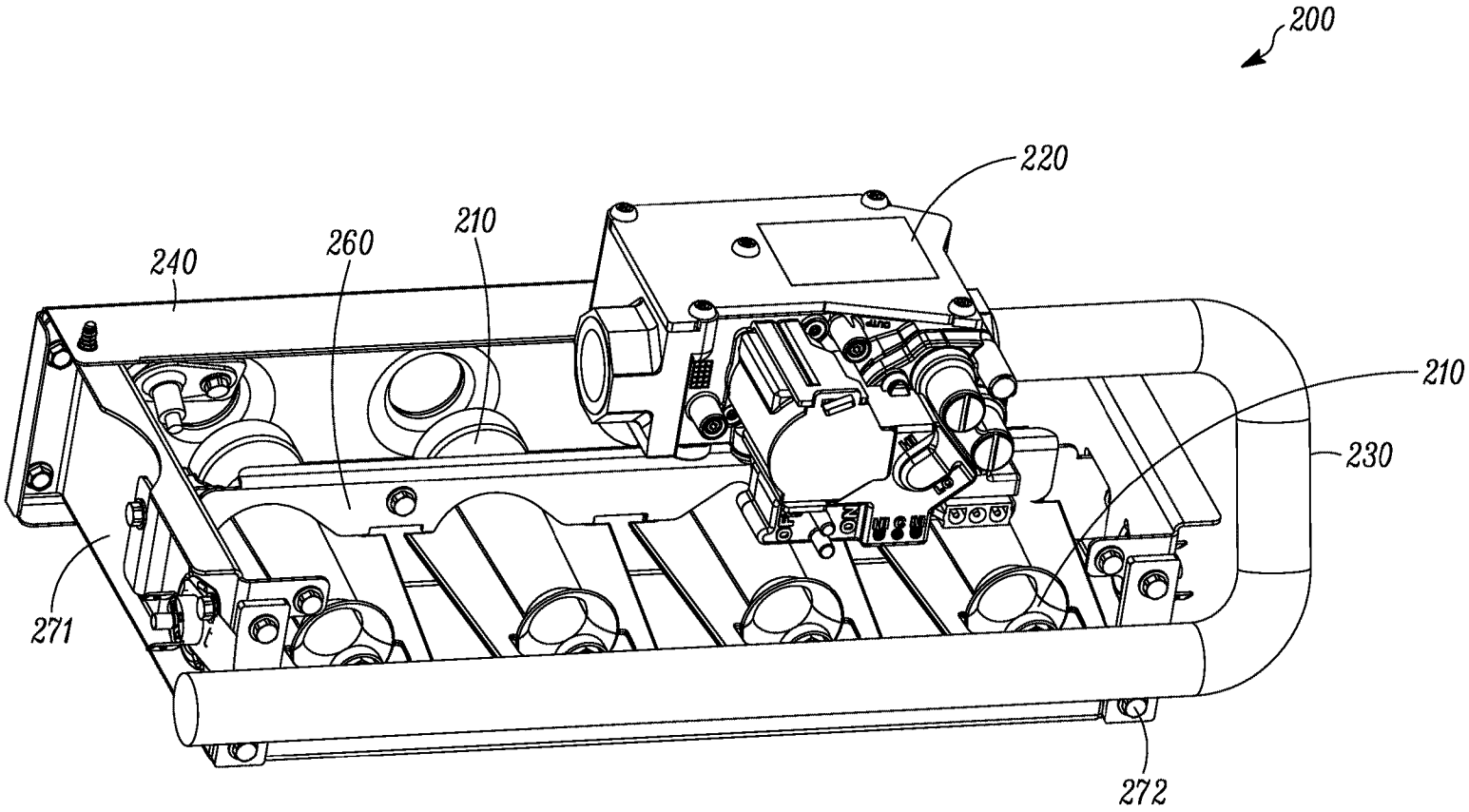
FIGS. 2A to 2E illustrate a burner system of a furnace, according to one embodiment.
Figure 2B:
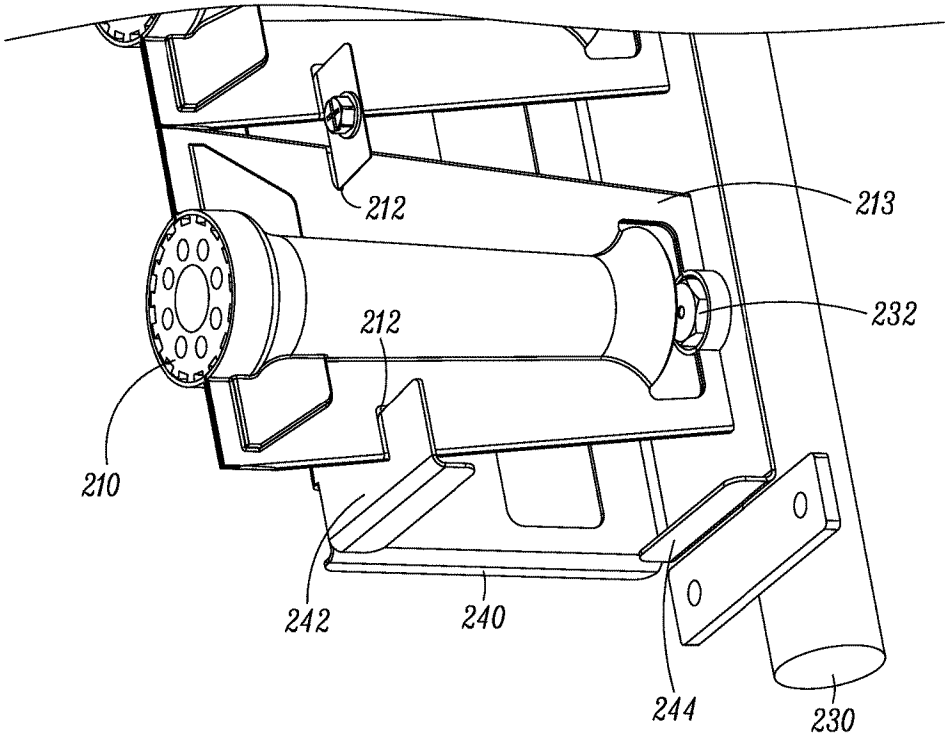

FIG. 2A illustrates an embodiment of a burner system 200. The burner system 200 includes at least one burner 210, a support assembly 240 to hold the burners 210, and a manifold 230 that can be attached to the support assembly 240. For example, the manifold may be attached, for example by one or more orifices 232 as illustrated in FIG. 2B (see below for more details). The support assembly 240 can be attached to a structural component 271 of the burner system 200 by one or more fasteners 272. A valve 220 can be attached to the manifold 230, as illustrated in FIG. 2A.

Figure 2C:
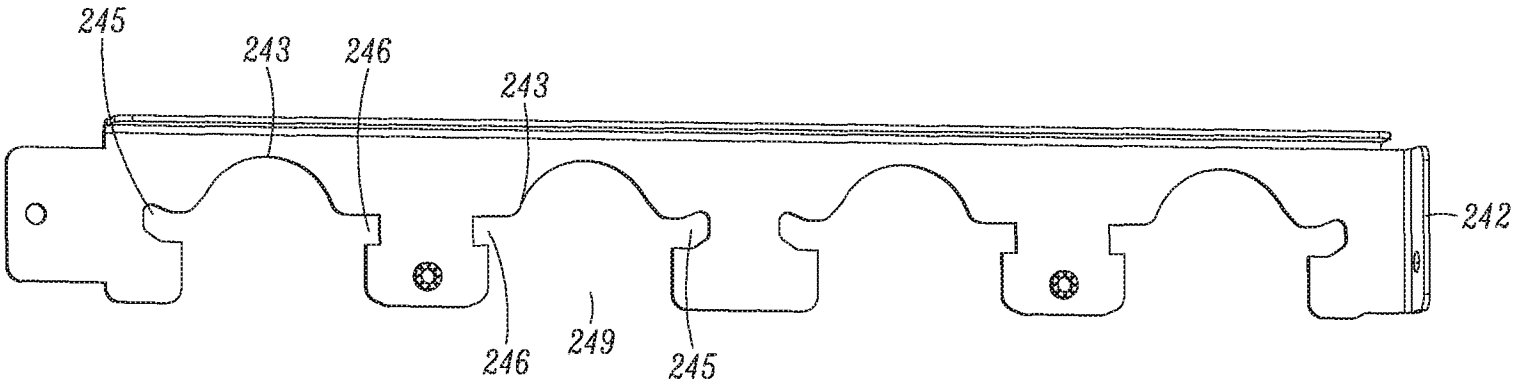

FIGS. 2A to 2C illustrate that the burner 210 is held on the support assembly 240 by a burner holder 242. In the illustrated embodiment, the burner 210 has a notch 212 that can engage the burner holder 242.

The support assembly 240 has a base portion 244. The burner 210 has a foot 213 that engages the base portion 244. As illustrated in FIGS. 2B and 2C, the foot 213 can be engaged with the base portion 244 without, for example, fasteners or connectors. The engagement of the burner 210 and the burner holder 242, and the engagement of the foot 213 and the base portion 244 help hold and support the burner 210.

In an embodiment, the support assembly 240, its base portion 244, and the burner holder 242 may be arranged and constructed as a cartridge for multiple burners.

Referring to FIG. 2C, details of the burner holder 242 are further illustrated. The burner holder 242 includes at least one cutout region 243 to accommodate the burner 210 as illustrated in FIG. 2A, 2B. The cutout region 243 includes an opening 249, a first ear 245 and a second ear 246.

Figure 2D:
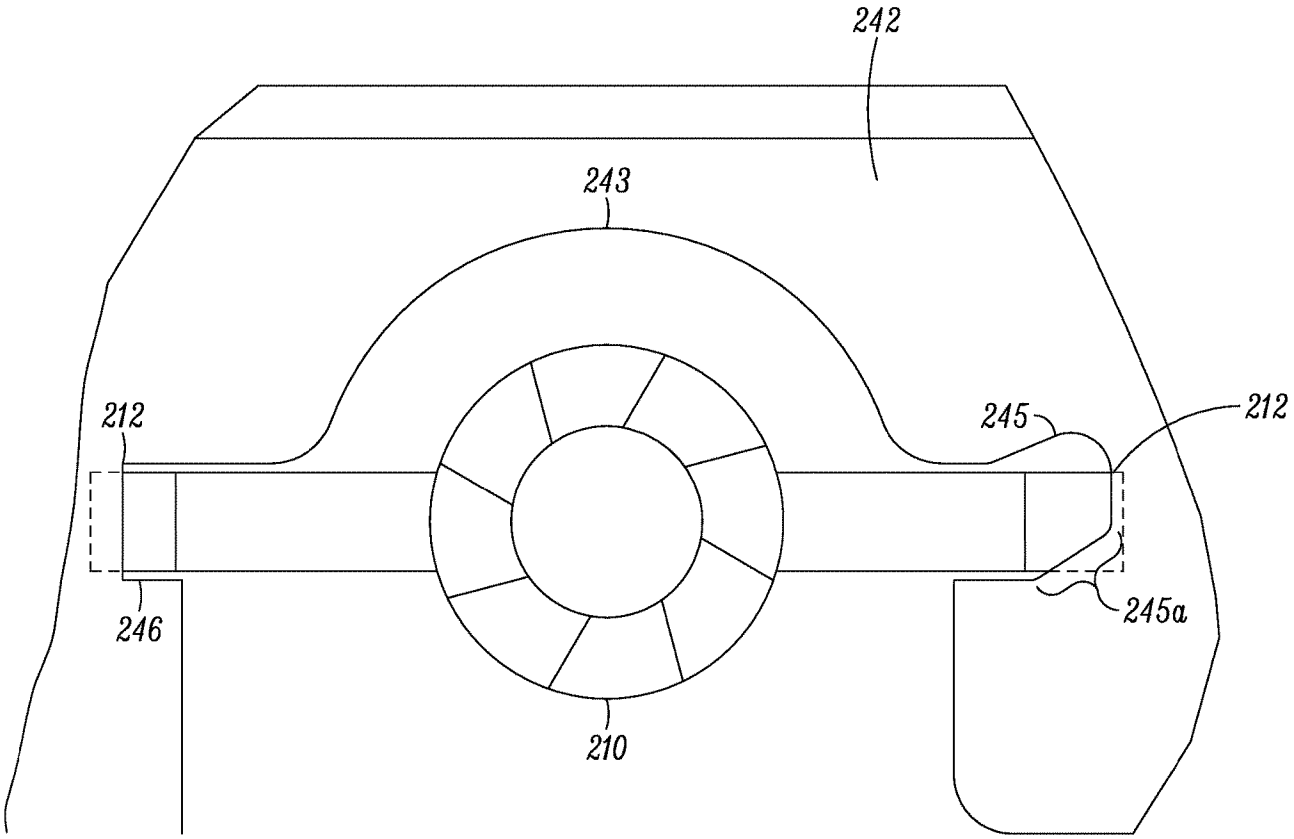
Figure 2E:
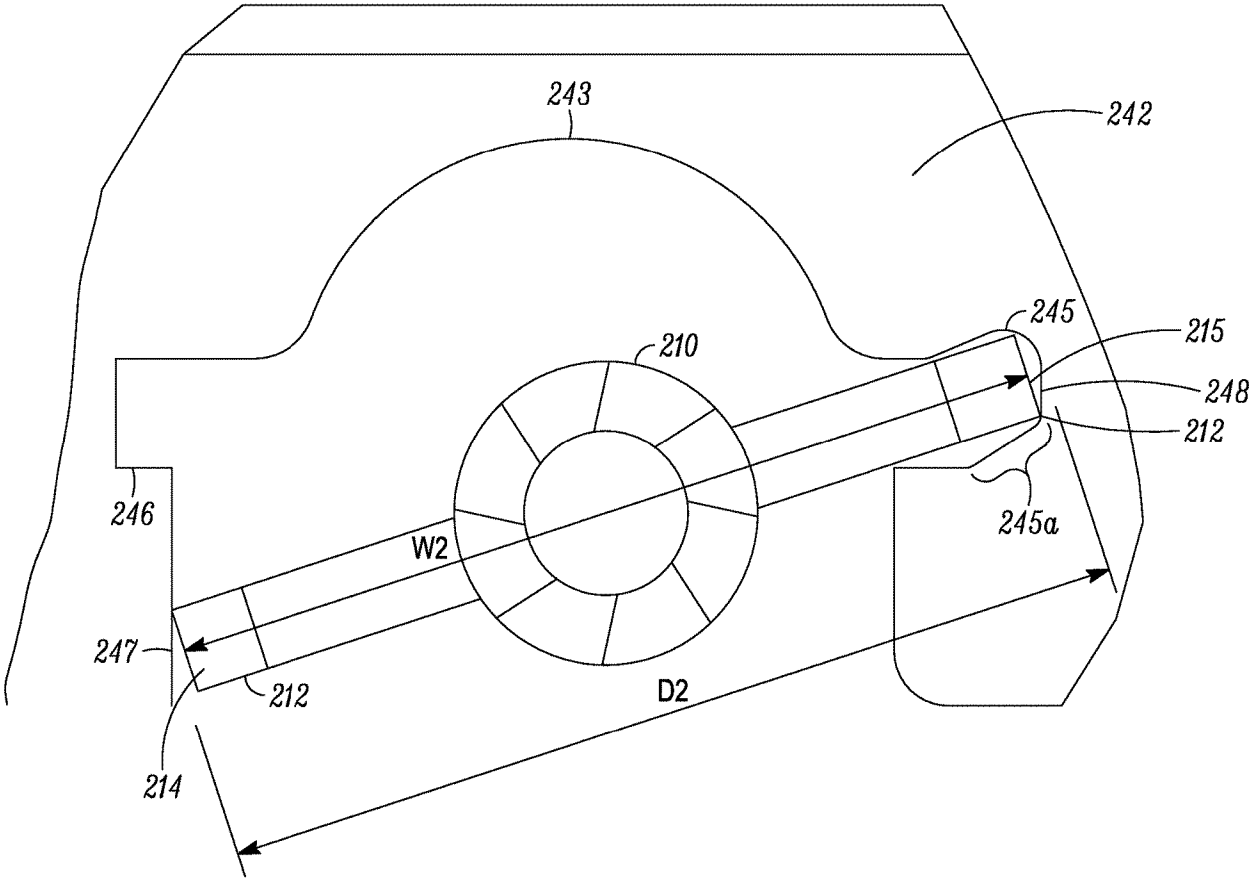

Referring to FIGS. 2D and 2E together, in an operational position as illustrated in FIG. 2D, the burner 210 is positioned between the first and second ears 245, 246. The notches 212 engage the first and second ears 245, 246, so that the burner 210 can be held in place during operation.

The first ear 245 has an angled portion 245*a*. In an disengaging position as illustrated in FIG. 2E, the burner 210 is twisted relatively to the operational position illustrated in FIG. 2D. When the burner 210 is twisted, a first side 214 of the burner 210 may be cleared from the burner holder 242 (e.g. cleared from an outer edge 247 of the cutout region 243), and a second side 215 of the burner 210 can have a clearance with respect to the first ear 245.

As illustrated in FIG. 2E, the second side 215 can have a clearance with the angled portion 245*a*, and the first side 214 can have a clearance with the outer edge 247 of the cutout region 243, which allows the burner 210 to be removed from the cutout region 243. The angled portion 245*a* is configured so that a distance D2 between a distal end 248 of the angled portion 245*a* and an outer edge 247 of the cutout region 243 is at least the same as a width W2 between the first and second sides 214 and 215 of the burner 210, e.g. in the view shown in FIG. 2E. This feature allows the burner 210 to be removed or installed from the disengaging position.

When the burner 210 is installed, the burner 210 can be positioned in the disengaging position first and then twisted into place. The angled portion 245*a* can help push the burner 210 into a desired position when the burner 210 is twisted.

Referring back to FIG. 2B, the foot 213 and the base portion 244 are not connected to each other by a fastener or other connectors. Thus, when the burner 210 is disengaged from the burner holder 242, the burner 210 can be disengaged from the base portion 244 simply by lifting the burner 210 away from the base portion 244.

Referring to FIG. 2C, the burner holder 242 can be configured to include more than one cutout regions 243. Profiles of the two neighboring cutout regions 242 are configured to mirror each other, so that the first ears 245 of the neighboring cutout regions 242 are positioned at different or opposite sides relative to the respective cutout regions 242. As shown for example, second ears 246 are proximate to each other and first ears are on sides that are farther apart. The feature helps avoid, for example, accidental disengaging of the burner 210 when a neighboring burner 210 is twisted.

The embodiments as disclosed herein allow a plurality of burners 210 to be removed or installed individually, reducing the need to handle more than one burner 210 simultaneously, which may be helpful during the service or maintenance process.

Referring back to FIG. 2A, a locking member 260 of the support assembly 240 can be attached to the burner holder 242 (not shown in FIG. 2A) to close the openings 249 of the cutout regions 243 (not shown in FIG. 2A). The locking member 260 and the burner holder 242 work together to retain and lock the burner 210 in place. When the locking member 260 is removed from the burner holder 242, the burner 210 still engages the first and second ears 245, 246 and is held by the first and second ears 245, 246. The burner 210 can be ready to be moved out of the cutout region 243, e.g. by twisting the burner 210 to disengage from the first and second ears 245, 246. The locking member 260 and the burner holder 242 configurations can help with remove/install the burner 210.

In the illustrated embodiment, the locking member 260 is a bracket that closes the opening 249 of the cutout regions 243. This is exemplary; and the locking member 260 can have other suitable configurations that may help retain and lock the burners 210 in place. For example, in some embodiments, the locking member may include a plurality of pieces, each of which may be used to retain and lock one burner 210. The locking member 260 can have a profile to accommodate the burner 210 so that when the locking member 260 engages the burner holder 242, the burner 210 may be locked into a desired position (for example, centered relative to, for example, the orifice 232 as illustrated in FIG. 2C).

Referring to FIG. 2B, the base portion 244 of the support assembly 240 can be attached to the manifold 230 by using an orifice 232 that may function as a fastener. The orifice 232 for example can be threaded, so that the orifice 232 is screwed into the manifold 230 directly.

The burner 210 can be moved in and out of the cutout region 243 by twisting the burner 210. The burner 210 can be removed and installed without detaching the manifold 230 from the support assembly 240. There is no need to remove the orifice 232 from the manifold 230. Referring to FIGS. 2A and 2B together, the embodiments as disclosed herein also allow the relatively easy removal and installation of the burners 210 individually e.g. for service and/or maintenance, without removing the orifice 232.

Figure 3A:
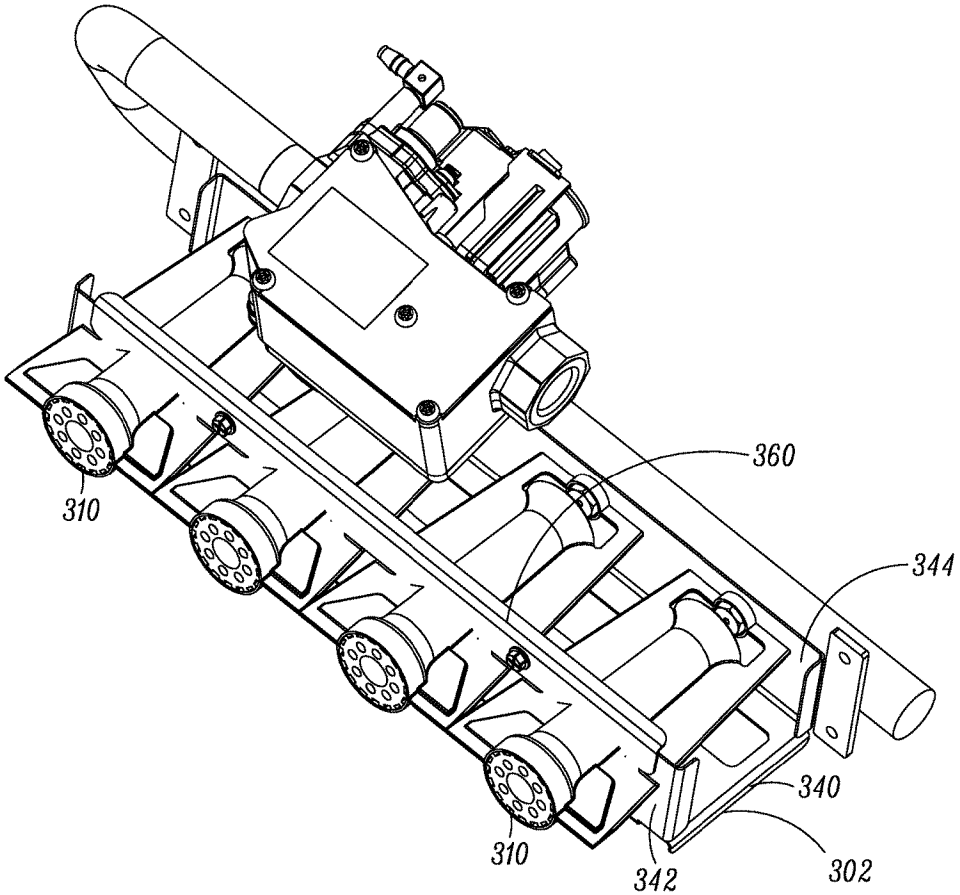
FIGS. 3A and 3B illustrate another embodiment of a support assembly implemented as a burner cartridge.
Figure 3B:
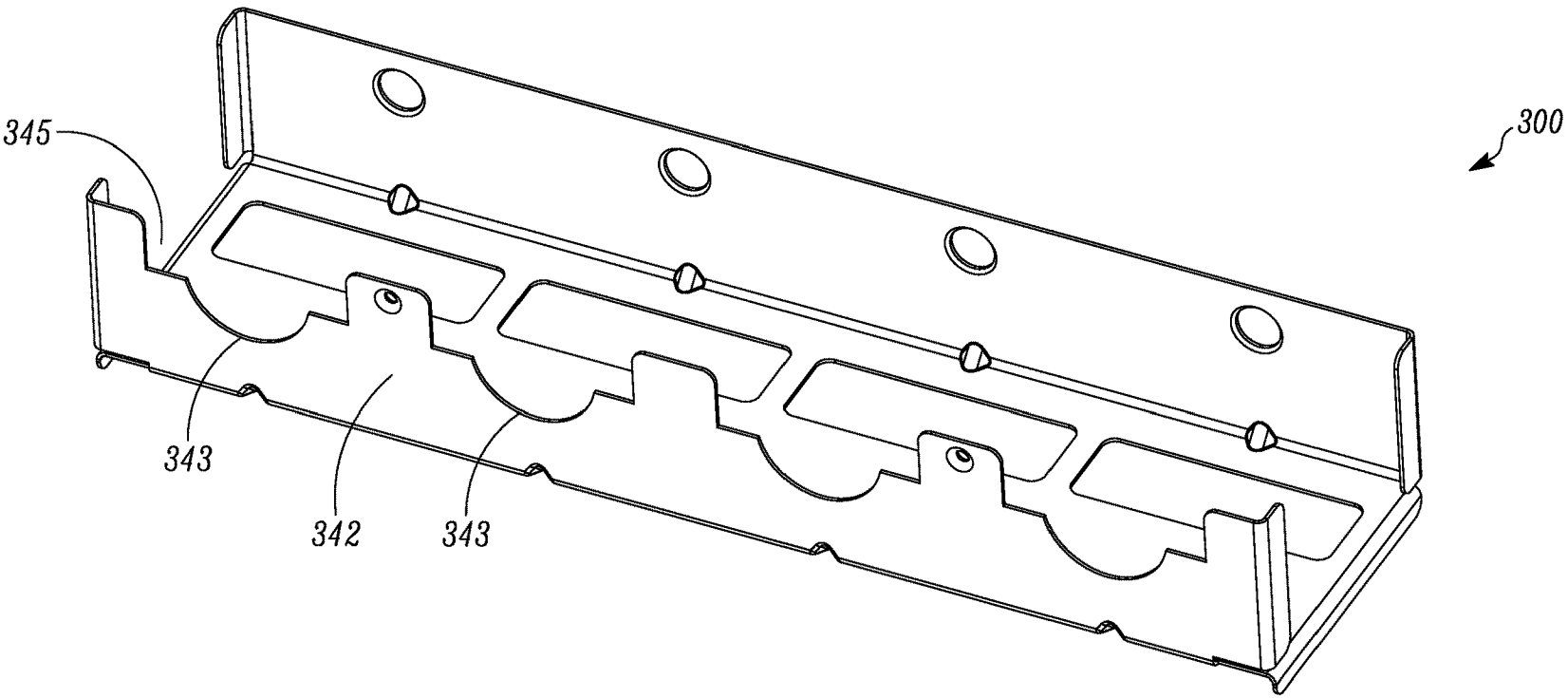

It is to be appreciated that in some embodiments, the cutout region may not include the ears. As illustrated in FIGS. 3A and 3B, a support assembly 300 may include a burner holder 342 with at least one cutout region 343 and a base portion 344 connected to the main support assembly portion 340. In an embodiment, the holder 342, the main support 340, and the base portion 344 are arranged and constructed as a cartridge. In an embodiment, the cutout region 343 may not have an ear-like structure (e.g. the first and second ears 245 and 246 illustrated in FIGS. 2E and 2F). In this configuration, a burner 310 may be removed or installed without twisting. However, in this configuration, the burner may only be held in place by a locking member (e.g. the locking member 360) closing an opening 345. If the locking member 360 is removed, the burner may no longer be held in place.

The embodiments of burner holders and cartridges as described herein include the manifold attached to the support assembly. For example, the burner cartridge can be attached to and removed from a structural component of the burner system as a single unit. During the burner removal and/or installation process, the burner cartridge can also be handled as one single unit, and where each burner may be individually handled. There is no need to dissemble the manifold from the support assembly. These features simplify service and/or handling of the burner system in the furnace.

ASPECTS

Aspect 1. A burner system, comprising:

a burner cartridge including a supporting assembly and a manifold; and at least one burner;

wherein the supporting assembly includes a burner holder or support and a locking member; the burner support has at least one cutout region configured to accommodate the at least one burner;

the at least one cutout region has an opening, a first ear and a second ear;

the burner has an operational position and a disengaging position;

when the burner is in the operational position, the burner is configured to engage the first ear and second ear, and when the burner is in the disengaging, the burner has a clearance with respect to the first ear and the second ear; and the locking member is configured to close the opening, and a profile of the locking member is configured to lock the burner into a desired position.

Aspect 2. The burner system of aspect 1, further comprising:

an orifice; wherein the support assembly is attached to the manifold by the orifice.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A burner system, comprising:

a supporting assembly;

a manifold; and at least one burner, the supporting assembly includes a burner holder; and a locking member connected to the burner holder, the burner holder has at least one cutout region configured to accommodate the at least one burner, the at least one cutout region has an opening, a first indentation configured to receive a first part of the burner, and a second indentation configured to receive a second part of the burner, wherein the first indentation is opposite to the second indentation of the at least one cutout region, the at least one burner has an operational position and a disengaging position, when the burner is in the operational position, the first part of the burner is configured to engage the first indentation and the second part of the burner is configured to engage the second indentation, and when the burner is in the disengaging position, the first part of the burner has a first clearance with respect to the first indentation and the second part of the burner has a second clearance with respect to the second indentation, and the locking member is configured to close the opening and lock the at least one burner into the operational position, the burner holder is configured such that when the burner is twisted in a first direction with respect to the burner holder, the first indentation engages the first part of the burner and then the second indentation engages the second part of the burner, and the burner holder is configured such that when the burner is twisted in a second direction with respect to the burner holder, the second clearance of the second part of the burner with respect to the second indentation is formed and then the first clearance of the first part of the burner with respect to the first indentation is formed.

2. The burner system of claim 1, further comprising:

an orifice; wherein the support assembly is attached to the manifold by the orifice, and the at least one burner is removable without dissembling the manifold from the support assembly.

3. The burner system of claim 1, wherein the at least one of the first and second indentations has an angled portion configured so that when the at least one burner is twisted from the operational position to the disengaging position, the at least one burner is removable due to the first and second clearances.

4. The burner system of claim 1, wherein the burner holder includes a plurality of cutout regions, where neighboring cutout regions have the first and second indentations respectively mirrored to each other.

5. The burner system of claim 1, wherein the at least one burner includes a notch that engages the burner holder.

6. The burner system of claim 1, wherein the support assembly includes a base portion and forms a cartridge structure with the burner holder.

7. A burner system, comprising:

a supporting assembly;

a manifold; and at least one burner, the supporting assembly includes a burner holder; and a locking member connected to the burner holder, the burner holder has at least one cutout region configured to accommodate the at least one burner, the at least one cutout region has an opening, a first indentation extending from the cutout into the burner holder, and a second indentation extending from the cutout into the burner holder, wherein the first indentation is opposite to the second indentation of the cutout, the at least one burner has an operational position and a disengaging position, when the burner is in the operational position, the burner is configured to engage the first indentation and the second indentation, and when the burner is in the disengaging position, the burner has a first clearance with respect to the first indentation and a second clearance with respect to the second indentation, and the locking member is configured to close the opening and lock the at least one burner into the operational position, the burner holder is configured such that when the burner is twisted in a first direction with respect to the burner holder, the first indentation engages a first part of the burner then and the second indentation engages a second part of the burner, and the burner holder is configured such that when the burner is twisted in a second direction with respect to the burner holder, the second clearance of the second part of the burner with respect to the second indentation is formed and then the first clearance of the first part of the burner with respect to the first indentation is formed.

8. The burner system of claim 7, further comprising:

an orifice; wherein the support assembly is attached to the manifold by the orifice, and the at least one burner is removable without dissembling the manifold from the support assembly.

9. The burner system of claim 7, wherein the at least one of the first and second indentations has an angled portion configured so that when the at least one burner is twisted from the operational position to the disengaging position, the at least one burner is removable due to the first and second clearances.

10. The burner system of claim 7, wherein the burner holder includes a plurality of cutout regions, where neighboring cutout regions have the first and second indentations respectively mirrored to each other.

11. The burner system of claim 7, wherein the at least one burner includes a notch that engages the burner holder.

12. The burner system of claim 7, wherein the support assembly includes a base portion and forms a cartridge structure with the burner holder.

* * * * *